US006324797B1

(12) United States Patent
Fago et al.

(10) Patent No.: US 6,324,797 B1
(45) Date of Patent: Dec. 4, 2001

(54) METHOD AND APPARATUS FOR COVERING SURFACES

(75) Inventors: Alex J. Fago, Franklin, OH (US); Jeffrey P. Wagner, Indianapolis, IN (US)

(73) Assignee: Therm-All, Inc., North Olmsted, OH (US)

( * ) Notice: Subject to any disclaimer, the term of this patent is extended or adjusted under 35 U.S.C. 154(b) by 0 days.

(21) Appl. No.: 09/318,394

(22) Filed: May 25, 1999

(51) Int. Cl.[7] ..... E04B 1/00

(52) U.S. Cl. ..... 52/222; 52/63; 52/98; 52/273; 52/408; 52/412; 52/506.05; 52/511; 160/327; 160/368.1; 160/370; 160/391

(58) Field of Search ..... 52/63, 222, 273, 52/98, 408, 412, 506.05, 511; 160/327, 368.1, 370, 391

(56) References Cited

U.S. PATENT DOCUMENTS

| | | | | |
|---|---|---|---|---|
| 3,149,436 | | 9/1964 | Varlonga . | |
| 3,186,712 | * | 6/1965 | Kessler | 52/222 |
| 3,304,995 | | 2/1967 | Goldstein . | |
| 3,783,931 | | 1/1974 | Assael . | |
| 3,822,734 | | 7/1974 | Tombu . | |
| 3,848,380 | | 11/1974 | Assael . | |
| 3,928,897 | | 12/1975 | Tombu . | |
| 4,053,008 | | 10/1977 | Baslow . | |
| 4,333,284 | * | 6/1982 | Meadows | 52/222 |
| 4,454,904 | | 6/1984 | Oxman . | |
| 4,782,883 | | 11/1988 | Braiotta . | |
| 4,788,806 | * | 12/1988 | Sease | 52/222 |
| 4,817,699 | | 4/1989 | Fein . | |
| 4,986,332 | | 1/1991 | Lanuza . | |
| 4,991,640 | * | 2/1991 | Verkindt et al. | 160/368.1 |
| 5,040,586 | | 8/1991 | Hillstrom . | |
| 5,134,822 | | 8/1992 | Edlin . | |
| 5,210,983 | * | 5/1993 | Kolk | 52/63 |
| 5,214,891 | | 6/1993 | Edlin . | |
| 5,501,047 | | 3/1996 | Delaunav et al. . | |

FOREIGN PATENT DOCUMENTS

WO 98/10947 3/1998 (WO) .

* cited by examiner

*Primary Examiner*—Carl D. Friedman
*Assistant Examiner*—Jennifer I. Thissell
(74) *Attorney, Agent, or Firm*—Jones, Day, Reavis & Pogue

(57) ABSTRACT

A wall system is disclosed including a covering member for covering a wall. A support structure is affixed to the wall for supporting the covering member. A support bracket is secured to the covering member and removably engages the support structure, in order to retain the covering member along a vertical wall.

17 Claims, 3 Drawing Sheets

METHOD AND APPARATUS FOR COVERING SURFACES

BACKGROUND OF THE INVENTION

The present invention is directed to the field of surface covering, e.g. covering walls and the like. The present invention has particular applicability for wall covering systems in which panels of insulation are supported from the walls.

A number of previous wall and surface covering systems are known for applying flexible panels of insulation and/or ornamental material. Such systems typically entail the securement of a panel to a stud or purlin using a complex intervening structure, such as a plurality of clips and the like. Such complex intervening structures are typically very expensive and difficult to install. Also, since clip structures secure the panels in localized positions, the panels tend to not be uniformly supported. This results in an uneven distribution of the load which may "pinch" or "gather" the board material, resulting in unstable securement and an unaesthetic appearance. Also, such variations in load may affect the insulating properties and may compromise the vapor seal of the panels.

Other systems have been developed for solving the above problems such as that described in U.S. Pat. No. 5,809,709, assigned to the present assignee, the disclosure of which is hereby incorporated by reference. This system includes a support member affixed to a wall with an interlocking PVC retaining member that engages a covering member therebetween in an interference fit. While this system overcomes the above problems, it can be somewhat difficult to assemble, requiring two persons. Also, it may happen that either the support member or retaining member may become misplaced, resulting in inconvenience and inefficiency of assembly.

With the previous design, if the thick insulation layer comes between the support and retaining members, securement is difficult. Thus, extra effort must be undertaken to insure that insulation is removed from between the secured members. The retaining member is generally secured to the support member using a directed force from a tool such as a rubber mallet. However, the PVC retaining member may crack under this force. Further, the retaining member is difficult to remove, in the event that adjustments or repair to the covering member are required.

SUMMARY OF THE INVENTION

In view of the difficulties and drawbacks associated with previous wall covering systems, it would be advantageous to provide a wall system which solves the previous problems while providing a more reliable and efficient system.

Therefore, there is a need for a wall system which provides even support and uniform load distribution.

There is also a need for a wall system which does not "pinch" or "gather" the wall panels.

There is also a need for a wall system which is less complex and uses fewer components.

There is also a need for a wall system which is less expensive to manufacture and install.

There is also a need for a wall system which permits single-person installation.

There is also a need for a wall system in which components are not easily misplaced, simplifying inventory.

There is also a need for a wall system that is not prone to breakage during assembly.

These needs and others are satisfied by the apparatus of the present invention in which a wall system is provided which includes a covering member for covering the wall. A support structure is affixed to the wall for supporting the covering member. A support bracket is secured to the covering member and removably engages the support structure, in order to retain the covering member along the vertical wall.

As will be appreciated, the invention is capable of other and different embodiments, and its several details are capable of modifications in various respect, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein.

DETAILED DESCRIPTION OF THE INVENTION

The drawings are now referred to illustrating only the preferred embodiment of the present invention and not for purposes of limiting the same. The present wall system 10 includes one or more covering members 12, which are preferably a laminate such as panels of insulation having a fiberglass layer and a vapor barrier or heat-reflective facing sheet. The facing sheet is made somewhat larger than the fiberglass layer on one or more sides so as to define an excess border portion that can be secured in the manner of the invention. Of course, other types of covering members e.g. fabric, could also be used without departing from the invention.

Figure 1:
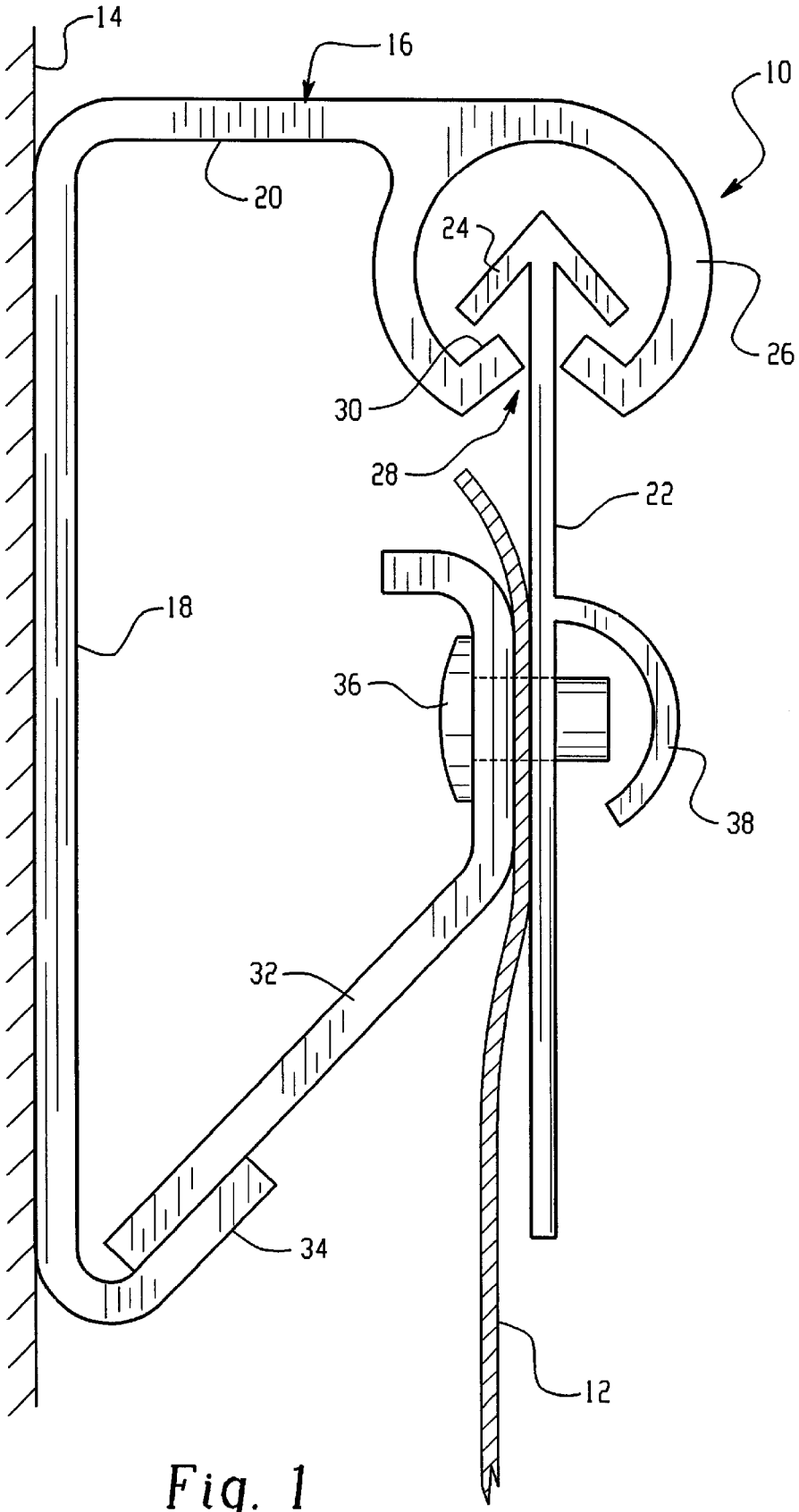
FIG. 1 is a side view showing an assembled wall system according to the present invention.

The covering member 12 is secured to a surface 14 with one or more support members 16. As shown in FIG. 1, the surface 14 is preferably a vertical wall such as is found in a building. The invention has particular applicability as used with concrete walls, such as free-standing or tiltable walls, precast wall panels and block walls such as are common in modern building construction. Of course, it will be appreciated that the invention has applicability to other wall types and also ceilings and other surfaces.

In the preferred embodiment, the support structure or support member 16 is a longitudinally extending body having a flat portion 18 for abutting the wall, and an extending portion 20, displaced from the wall, preferably in a perpendicular manner. The support member 16 is longitudinally affixed to the wall surface 14 along a horizontal length, e.g. near the top of the wall 14, using a screw or other securement (e.g. adhesive, lag bolts, power actuated fasteners, pneumatic fasteners, etc.). The support member 16 can also include an intervening layer between the wall surface 14, such as a length of styrofoam, wood or the like to provide additional insulation and a vapor barrier. Support members 16 can be attached at the top of a vertical wall, but they also can be attached at the bottom, in order to secure both ends of a covering member 12. Also, a support member 16 having a different type of profile can be used to secure the bottom.

The covering member 12 is secured to a support bracket 22, which removably engages with the support member 16 to retain the covering member along the vertical wall 14. The support bracket 22 is also a longitudinally extending body, preferably generally planar, that extends substantially the length of the support member 16. The support bracket 22 and the support member 16 are removably engaged using first and second engagement structures, formed respectively on support member 16 and the support bracket 22.

In the preferred embodiment, these engaging structures include a head portion 24 which engages with a cavity portion 26. In the illustrated embodiment, the head portion 24 is an enlarged portion preferably formed on the top longitudinallyextending edge of the support bracket 22. As shown, the head portion 24 is of a generally arrowhead-shaped configuration, but of course any other suitable head portion design could be contemplated without departing from the invention.

As illustrated, the cavity portion 26 is a substantially enclosed, longitudinally-extending structure, formed on the extending portion 20. The cavity portion preferably has a generally circular cross-section, but any shape cross-section can be formed without departing from the invention. The cavity portion 26 includes a longitudinally-extending slot 28 which has an opening smaller than the head portion 24 but larger than the thickness of the support bracket 22. Upon assembly, the edge of the head portion 24 is slid into the open end of the cavity portion 26. In this way, the support bracket 22 is received and retained by the support member 16, and hangs thereon. This assembly process can easily be performed by a single installer, thereby providing simplified assembly. The edges of the cavity portion 26 can be shaped to form seats 30 to accommodate the shape of the head portion 24. This provides greater support and stability to the assembled wall system 10. It should be appreciated that the head portion 24 and the cavity portion 26 can be reversed, i.e., respectively formed on the support member 16 and support bracket 22, without departing from the invention.

The covering member 12 is preferably longitudinally secured to the support bracket 22 along a section displaced from longitudinal edge of the support bracket 22, so as to not interfere with the engaging portions. In order to provide additional support to the covering member 12, a brace 32 is secured to the support bracket 22. This brace 32 is angled so as to be received in a channel 34, formed on the support member 16, in order to assist in bearing the weight of the wall system 10. The brace 32 can be laterally slid into the channel 34 when the bracket 22 is slid, or can be optionally flipped underneath after assembly, depending on the technique of the installer. The channel 34 is preferably formed as a hooked end of the flat portion 18. The brace 32 can be secured to the support bracket 22 in any known manner, e.g. adhesives, etc. In the illustrated embodiment, these components are secured by a plurality of rivets 36, which are placed at appropriate distances along the longitudinal extent. The frequency of the rivets 36 can vary by the weight and length of the covering member 12 to be supported.

The covering member 12 is preferably sandwiched between the brace 32 and the support bracket 22. In this way, the securing force of the rivets 36 is distributed evenly along the junction of these components, providing an even distribution of support for the covering member 12. The support bracket 22 also includes a flap 38, which also extends longitudinally, and serves to conceal the rivets 36, thereby providing a finished aesthetic appearance and improving safety, by concealing the potentially sharp ends of the rivets 36.

Figure 2B:
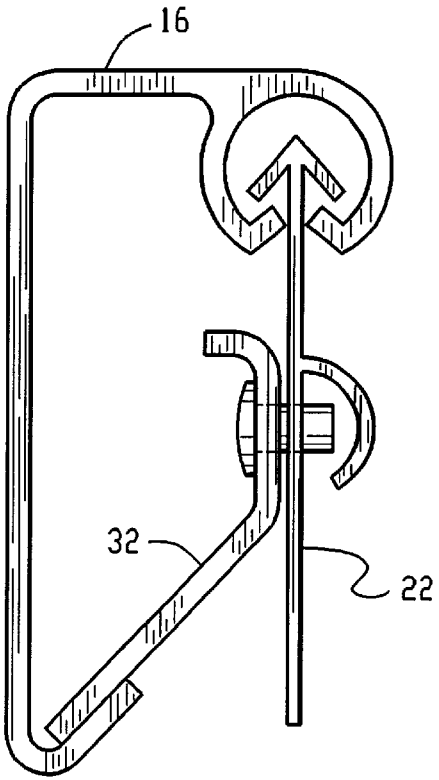
FIGS. 2A and 2B are respective side views showing the assembled and coextruded components of the wall system as according to an embodiment of the present invention.
Figure 2A:
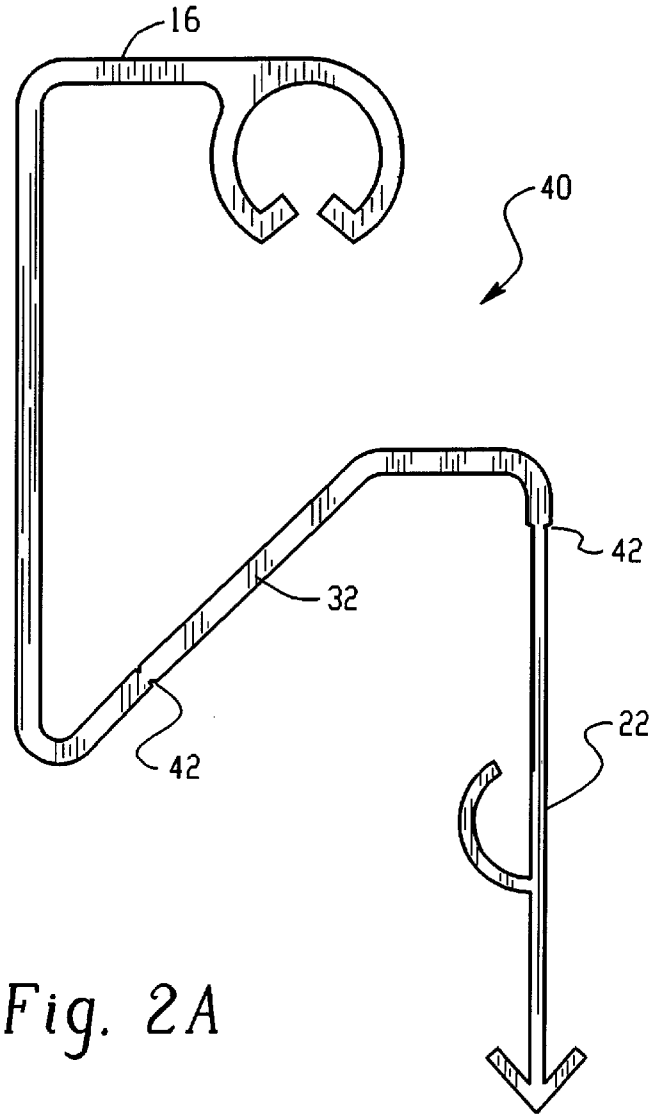
Figure 3A:
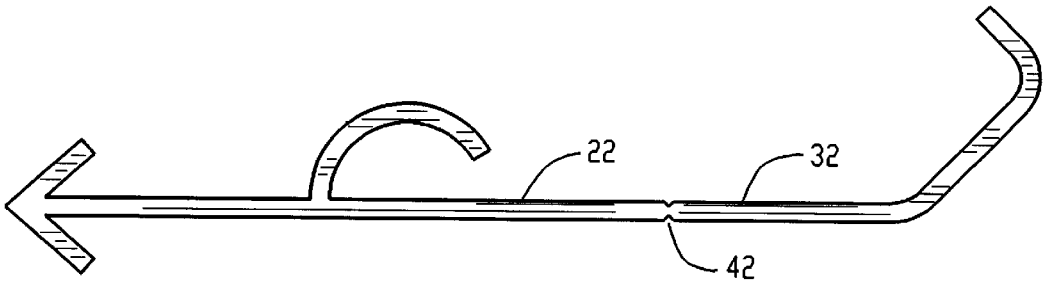
FIGS. 3A and 3B are respective side views showing separately extended components of the wall system as according to an alternate embodiment of the present invention.
Figure 3B:
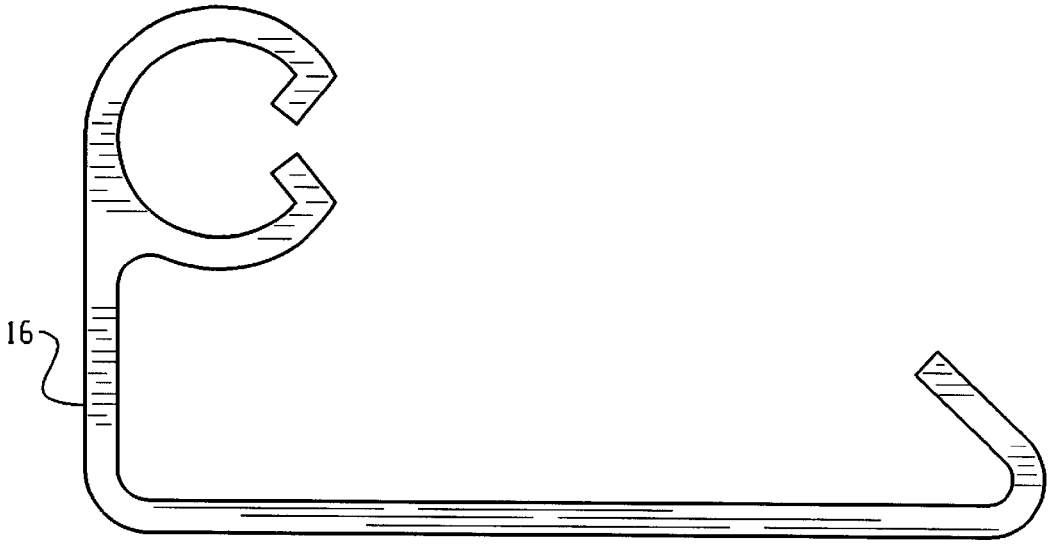

The support components of the present wall system 10 are all longitudinally-extending, and preferably all of substantially equal length. Thus, in an additional aspect of the invention, the support member 16, the brace 32 and the support bracket 22 can all be formed of a single extrusion 40 and assembled as shown in FIG. 2B. These components are preferably made of a suitable plastic, e.g. PVC, however any extrudable material could be used without departing from the invention. The coextruded components 16, 22, 32 are separable along integrally-formed score lines 42, which permit easy separation by an installer at the job site. This reduces handling considerations by insuring that all three parts are in hand, avoiding misplacement and lost time in locating parts. This design also reduces inventory and manufacturing expense, as only one part need by manufactured and accounted for per wall system. However, it should be understood that the present components can also be individually extruded or partially coextruded, as indicated in FIGS. 3A and 3B.

As described hereinabove, the present invention solves many problems associated with previous surface coverings, and presents improved efficiency and operability. However, it will be appreciated that various changes in the details, materials and arrangements of parts which have been herein described and illustrated in order to explain the nature of the invention may be made by those skilled in the art within the principle and scope of the invention as expressed in the appended claims.

We claim:

1. A system for covering a vertical wall comprising:

a covering member for covering said wall;

a support member for affixing to said wall and supporting said covering member;

a support bracket, secured to the covering member, for removably engaging with the support member, to retain the covering member along the vertical wall;

the support member including a channel;

a brace secured to the support bracket, the brace residing in and being supported by the channel; and the brace and the support bracket being secured with a plurality of rivets, with the covering member sandwiched therebetween.

2. The system of claim 1 wherein the support bracket further comprises a flap for concealing an exposed end of the rivets.

3. A system for covering a vertical wall comprising:

a covering member for covering said wall;

a support member for affixing to said wall and supporting said covering member;

a support bracket, secured to the covering member, for removably engaging with the support member, to retain the covering member along the vertical wall;

the support member including a channel;

a brace secured to the support bracket, the brace residing in and being supported by the channel; and the support member, the support bracket and the brace being coextruded and separable along integrally-formed score lines.

4. A three piece system for supporting a wall covering member in covering relationship to a vertical wall comprising:

a support member attachable to a vertical wall for supporting a wall covering member, the support member having a channel;

support bracket securable to the wall covering member and removably engageable with the support member to retain the wall covering member along a vertical wall; and a brace secured to the support bracket, the brace residing in and being supported by the channel.

5. The system of claim 4 wherein the three piece system of the support member, support bracket and brace are coextruded in one-piece and separable from one another along score lines.

6. The system of claim 4 wherein one of the support member and support bracket includes a head portion and the other includes a cavity portion for receiving the head portion, a wall covering member being securable between the support bracket and brace outside of the cavity portion and spaced from the head portion and the cavity portion.

7. The system of claim 4 wherein the support member includes a wall attaching portion having an extending portion extending outwardly therefrom, the extending portion having a cavity with a slot that opens outwardly in a direction parallel to a vertical wall to which the attaching portion is attachable, and the support bracket having a head receivable in the cavity with the remainder of the support bracket extending through the slot in outwardly-spaced parallel relationship to a vertical wall on which the support member is mounted.

8. A system for covering a vertical wall comprising:

a covering member for covering said wall;

a support member for affixing to said wall and supporting said covering member;

a support bracket secured to the covering member for removably engaging with the support member to retain the covering member along the vertical wall;

the support member including a channel;

a brace separate from and independent of the support bracket;

the brace having one brace end portion secured to the support bracket independently of and in spaced relationship to the engagement between the support bracket and the support member and with the covering member sandwiched between the one brace end portion and the support bracket; and the brace having an opposite brace end portion residing in and being supported by the channel.

9. Apparatus for supporting a wall covering member on a vertical wall comprising:

a support member having a wall attaching portion for attaching the support member to a vertical wall;

said support member having an extending portion that extends outwardly away from said wall attaching portion;

a bracket attachable to said extending portion of said support member for supporting a wall covering member parallel to a vertical wall;

said bracket and said extending portion of said support member having a cooperating cavity and head thereon for supporting the bracket in outwardly-spaced parallel relationship to a vertical wall with said head received in said cavity;

said cavity having a slot that opens outwardly in a direction parallel to a vertical wall to which said support member is attached;

a brace extending between said wall attaching portion of said support member and said bracket; and said brace having one brace end portion attachable to said bracket and an opposite brace end portion supportable on said wall attaching portion of said support member.

10. The apparatus of claim 9 wherein said wall attaching portion of said support member includes a channel in which said opposite brace end portion is supported.

11. The apparatus of claim 10 wherein said one brace end portion is attachable to said bracket with a wall covering member sandwiched therebetween.

12. The apparatus of claim 9 wherein said one brace end portion is attachable to said bracket with a wall covering member sandwiched therebetween.

13. The apparatus of claim 9 wherein said cavity is on said extending portion of said support member and said head is on said bracket, and said bracket extends through said slot in said cavity in outwardly-spaced parallel relationship to a vertical wall on which said wall attaching portion is mounted when said head is received in said cavity.

14. The apparatus of claim 9 wherein said brace is inclined from said one brace end portion to said opposite brace end portion in a direction toward said wall attaching portion of said support member and away from said extending portion of said support member.

15. The apparatus of claim 14 wherein said wall attaching portion of said support member includes a channel that opens toward said extending portion of said support member, and said opposite brace end portion being supportable by said channel.

16. A system for covering a vertical wall comprising:

a covering member for covering said wall;

a support member for affixing to said wall and supporting said covering member;

a support bracket secured to the covering member for removably engaging with the support member to retain the covering member along the vertical wall;

the support member including a channel;

a brace having one brace end portion secured to the support bracket by a plurality of fasteners with the covering member sandwiched therebetween; and the brace having an opposite brace end portion residing in and being supported by the channel.

17. A system for covering a vertical wall comprising:

a covering member for covering said wall;

a support member for affixing to said wall and supporting said covering member;

a support bracket secured to the covering member for removably engaging with the support member to retain the covering member along the vertical wall;

the support member including a channel;

a brace having one brace end portion secured to the support bracket with the covering member sandwiched therebetween;

the brace having an opposite brace end portion residing in and being support by the channel;

one of the support member and the support bracket having a cavity and the other having a head receivable in the cavity; and the wall covering member being secured between the one brace end portion and the support bracket outside of the cavity and in spaced relationship to both the cavity and the head.

* * * * *